US011396353B2

(12) United States Patent
Mucsi

(10) Patent No.: US 11,396,353 B2
(45) Date of Patent: Jul. 26, 2022

(54) HORSESHOE LIFE BUOY FOR WATER RESCUE AND ASSOCIATED RESCUE ROPE ASSEMBLY

(71) Applicant: László Mucsi, Fonyód (HU)

(72) Inventor: László Mucsi, Fonyód (HU)

( * ) Notice: Subject to any disclaimer, the term of this patent is extended or adjusted under 35 U.S.C. 154(b) by 0 days.

(21) Appl. No.: 17/058,054

(22) PCT Filed: May 31, 2019

(86) PCT No.: PCT/HU2019/050026
§ 371 (c)(1),
(2) Date: Nov. 23, 2020

(87) PCT Pub. No.: WO2019/229487
PCT Pub. Date: Dec. 5, 2019

(65) Prior Publication Data

US 2021/0155327 A1 May 27, 2021

(30) Foreign Application Priority Data

Jun. 1, 2018 (HU) ..... P1800185

(51) Int. Cl.
*B63C 9/08* (2006.01)
*B63C 9/26* (2006.01)

(52) U.S. Cl.
CPC ..... *B63C 9/082* (2013.01); *B63C 9/26* (2013.01)

(58) Field of Classification Search
CPC .... B63C 9/00; B63C 9/08; B63C 9/22; B63C 9/26; B63C 9/082; B63C 2009/0023
USPC ..... 441/441, 80, 81, 83, 84, 87, 88
See application file for complete search history.

(56) References Cited

U.S. PATENT DOCUMENTS 3,579,683 A * 5/1971 Robertson ..... B63C 9/082 441/81
3,696,453 A * 10/1972 Harris ..... B63C 9/22 114/190
4,702,715 A * 10/1987 Winick ..... B63C 9/08 441/6
7,896,719 B2 * 3/2011 Rayles ..... B63C 9/21 441/84

* cited by examiner

*Primary Examiner* — Daniel V Venne
(74) *Attorney, Agent, or Firm* — Handal & Morofsky, LLC

(57) ABSTRACT

Horseshoe life buoy (10) for water rescue comprising a horseshoe shaped body lighter than water and between the two ends (7, 8) thereof a curved inner cavity (6) is provided which is sufficiently large to receive a subject (5) to be rescued, and for the receiving of an end of a rescue rope (3) held by a subject (4) carrying out the rescue to the horseshoe life buoy (10) an attachment means is provided, wherein the attachment means is a strap (12) mechanically connected with the body of the horseshoe life buoy (10), which is arranged at the very front of the horseshoe life buoy (10) symmetrically to the center of the body at the outer edge opposite to the inner cavity (6).

15 Claims, 4 Drawing Sheets

HORSESHOE LIFE BUOY FOR WATER RESCUE AND ASSOCIATED RESCUE ROPE ASSEMBLY

The invention relates to a horseshoe life buoy for water rescue and to an associated rescue rope assembly. For water rescue purposes several life saving devices are known but in case of sailing boats and boats the use of horseshoe-shaped life buoys is widely spread. Life saving devices that have densities smaller than that of water having shapes similar to a horseshoe or to a U-shape have been known for a long time and they are referred to as "horseshoe life buoys". Such a device is published e.g. in U.S. Pat. No. 3,579,683 in which on the outside of the horseshoe shaped body there is a central recess which makes it possible that the two ends of the body made by a plastic foam material can be flexibly opened to allow that the branches of the horseshoe surround the subject to be rescued.

The publication EP1216919 A1 describes a different kind of horseshoe life buoy which has a body made of flexible plastic sheets and can be blown as a balloon, and it has a casing that comprises a cartridge with carbon dioxide. During use the cartridge opens and the gas blows the horseshoe life buoy to its final form and at this step the casing tears up and disappears. The advantage of this solution is the small space requirement for storage, at the same time it is expensive and the use is complicated.

The floating life-saving devices on boats and small ships are constituted in about 90-95% by horseshoe life buoys. In everyday use horseshoe life buoys made of plastic foam sheets with a thickness of 8-12 mm are used so that the horseshoe-shaped sheets are placed on one another and connected by gluing. In given cases the sheets can be interconnected by a common casing. A characteristic of such horseshoe life buoys is that the foam material cannot resist larger pressures. The plastic body is therefore surrounded by a band comprising loops for receiving a rope or a ribbon, and in this assembly the rescue rope can be attached from the open side of the horseshoe. In this way the forces applied on the horseshoe life buoy by the rescue rope are distributed along a greater surface, and the material of the horseshoe life buoy can resist such loads.

Such horseshoe life buoys and the associated assemblies can be purchased in commerce e.g. in the websites https://www.decathlon.hu/mentopatko-hajozashoz-id_8337022.html and http://www.trinexus.hu/termek/ment-patko-p47.

The knowledge of the requirements imposed against horseshoe life buoys and the associated assemblies is found important from the point of view of learning the problems coming from the imperfect satisfaction of such requirements including the description of the details of life saving in water.

On water an emergency situation can arise at any time, however it appears most frequently under difficult weather conditions (strong wind, high waves). Such situations can be made more difficult by other outer circumstances e.g. rain, low temperature, but also subjective components can make the situation more difficult like increased stress, injures or lack of routine. Owing to such reason: the theoretically simple process of rescuing includes the reality a number of difficulties. The key components of a successful rescue lie in speed and expertise. Because most of non-professional sailors experience in all of their lives only the solution of a few emergency situations therefore one cannot expect from such subjects the routine and expertise what professional sailors or trained rescue personnel have. The lack of routine causes stress situations that slow the solution of the situation or it can even block such solutions. Like expertise the speed is also an important condition of a successful rescue. The conditions of the danger of drowning or cooling of the subject to be rescued as well as the possibilities for his/her exhaustion and injures are always at hand.

The invention to be described in the following assists, simplifies and speeds up the rescue of subjects who have not got black-out and capable of action.

During an emergency situation (e.g. the rescue of the staff of an overturned ship) the rescue operation includes the following steps:

1. following an appropriate approach the obtaining of the rescue equipment (floating device and rope);
2. when required the fixing of the rope to the rescue equipment (in most cases this condition is already fulfilled);
3. the freeing of the rope and arranging it in professional loops before throwing out;
4. the throwing of the rescue device towards a person to be rescued;
5. the throwing is often in-accurate and in such cases the equipment should be pulled back and the steps of points 3. and 4. should be repeated until the equipment takes an acceptable position by the person to be rescued;
6. the person to be rescued swims by a few movements to the equipment and takes an appropriate position and grasps the device;
7. the rescuing person pulls the subject to be rescued by means of the rope to the ship/boat/shore;
8. then the subject is assisted to arrive.

The use of the conventional rescue equipments during the above outlined rescue steps and the associated problems will be shortly described in connection with FIGS. 1-3. The rescue equipment shown in FIG. 1 comprises a floating rescue device in the exemplary case a horseshoe life buoy 1 that can be a life ring or life plate, and a band 2 surrounding the device (which can also be a rope) that is attached thereto in advance, and a rescue rope 3 held by the rescue person and which is attached later to the device.

When using the conventional equipment the problems explained in connection with FIGS. 2 and 3 emerge. The rescuing person 4 is shown in FIG. 2 who holds the rescue rope and also the person 5 to be rescued. For the person 5 to be rescued a difficulty lies in getting into the interior of the horseshoe life buoy 1, because his/her clothing or in given cases the life vest if present can easily get blocked by the presence of the loose rescue rope 3 in front the opening of the horseshoe. If the entry is successful during the pulling of the rescue rope 3 forces may arise that turn the body of the person 5 to be rescued in forward direction where the horseshoe is open and there is no support present. In case of a strong pulling the person 5 to be rescued can easily get out of the horseshoe. Instead of the correct and safer positioning shown in FIG. 2 the person 5 to be rescued will not even try to enter the interior of the horseshoe life buoy 1 and grasps only from the outside in the way as shown in FIG. 3. In such cases the horseshoe life buoy 1 looses practically all its advantages i.e. that the horseshoe surrounds the person 5 from three sides and would limit his/her turning around its own longitudinal axis. With such uses the device could be replaced by any floating object into which one can grasp.

A further problem is provided from the fact that the rescue rope 3 should have floating properties (i.e. a density lower than that of the water), from which it follows that the material of the rescue ropes is a plastic having low surface tension (e.g. polyethylene or polypropylene) because such materials are less dense than water. These materials are quite slippery even when dry, but under wet conditions they are more slippery. The diameter of the rescue rope can neither be too small or too great. In case of thick ropes the great weight brakes down the impulse during the throw and cannot be thrown to greater distances, and in case of thin ropes the handling gets difficult. According to standard practice the diameter of the rescue rope is around 6-8 mm. In practice this means, that the rescuing person 4 has to hold a thin, rather slippery rope in his hands which imposes a challenge for him if the flow stream of the water is strong (e.g. in a river) or if the body represents a high resistance when the rescue rope 3 can easily slip out of his hands or if there is a great friction that can cause injures.

A further difficulty lies in the correct collection of the rescue rope 3. The fast and correct pulling of the rescue rope 3 causes difficulties even for the staff of the rescuing boat, and if that task should be solved by a passenger present of the boat who has never had such experience, this is more difficult. The speed is a very important component and it has an increased significance if several throwing tests have proven unsuccessful.

A further problem is constituted by the need of throwing the horseshoe life buoy to the required distance. One reason is coming from the fact, that the horseshoe life buoy 1 does not have a good place to be held. One can throw the thick body of the buoy only with awkward movements that allows only short distance throw. In this way the full length of the rescue rope 3 cannot be completely utilized. The device can be thrown to greater distances if it is held by the surrounding band, but in such cases the throw itself cannot be directed accurately because of the flexibility of the band.

The distance of the throw is limited additionally by the fact that when throwing the horseshoe life buoy one accelerates a rather light object which results in a slow impulse. This impulse is not only decreased by the resistance provided by the air, but also by the fact that the device should pull always longer sections of the rope as it gets into greater distances from the site of the throw. This further decreases the remaining impulse; therefore this is a further reason why the full length cannot be utilized.

The making of the suitable and durable knot required for the interconnection of the rescue rope 3 and the band 2 does appear as a problem only infrequently as such connection is provided often in advance. When such problems still emerge then this constitute a time consuming operation especially if this task should be carried out by subjects without routine.

Problems can also emerge with the technical solution of the haulage. The situation is that in the design shown in FIG. 1 the rescue rope 3 makes a loop around the band 2 but this connection does not prevent the loop to slide in lateral direction along the band, i.e. the loop can take a position at one of the ends of the horseshoe. If the direction of the pulling force closes an angle with the central axis of the horseshoe life buoy 1 then the horseshoe life buoy 1 can only turn in the pulling direction when the loop slides till the appropriate edge of the band 2. In this position however as a result of the applied forces the horseshoe life buoy 1 can move out of its stable position and the person 5 to be rescued can get into the water. Similarly, in case if a vertical fixing is provided, then the loose connection between the loop and the band can cause stability problems.

Finally, the problems to be solved includes the common and stable storage of the horseshoe life buoy 1 and the rescue rope 3, because the rope 3 should be stored close to the horseshoe life buoy 1 or in a state attached thereto, however the rope 3 should be in a position ready for immediate use.

The problems outlined in the preceding paragraphs apply in case of known and generally used horseshoe life buoys and there is a definite need for technical solution which can at least partially eliminate these problems or at least make them less serious.

The object of the invention is to provide a horseshoe life buoy and rescue rope assembly which at least partially eliminates these problems or make them less serious.

For solving the task a horseshoe life buoy has been provided for water rescue purposes that comprises a horseshoe shaped body lighter than water and between the two ends thereof a curved inner cavity is provided which is sufficiently large to receive a subject to be rescued, and for the receiving of an end of a rescue rope held by a subject carrying out the rescue to the horseshoe life buoy an attachment means is provided, wherein according to the invention the attachment means is a strap mechanically connected with the body of the horseshoe life buoy which is arranged at the very front of the horseshoe life buoy symmetrically to the center of the body at the outer edge opposite to the inner cavity.

For respecting the sensitive material of the horseshoe life buoy which is exposed to injure it is advisable if the strap is connected to a band that surrounds the center part of the body of the horseshoe life buoy which widens towards the inner cavity.

It is preferred if on one surface of the band normal to the strap a transverse handle is arranged that facilitates throwing the horseshoe life buoy.

For the stable attachment of the end of the rescue rope it is preferred to the interior of the strap at a short central section a loop fixing strap is attached at both ends to the strap, and the end of the rescue rope can be threaded in the opening formed between the two straps.

It is preferred if between the widened inner surface of the band which is opposite to the strap and the edge of the inner cavity a curved force distribution plate is arranged.

For the assembly of the rescue rope and for fixing it to the horseshoe life buoy it is preferred if respective pocket holding ribbons are attached to the two inner sides of the band that encircle the body of the horseshoe life buoy and on their surfaces where the transverse handle is arranged respective longitudinal pockets are formed, and on the band a ribbon is provided that holds the strap and embraces the body of the horseshoe life buoy and the ribbon is provided with a strong Velcro lock.

According to the invention a life saving rope assembly has also been provided for a horseshoe life buoy, that comprises a rescue rope that can be connected by one end to the horseshoe life buoy, which comprises a rigid rod-like handle, a pair of rope holding rods extending out in the same direction from the two ends of the handle, wherein the other end of the rescue rope is fixed to the handle and the rescue rope can be wound in its whole length between the two rope holding rods.

It is preferred if the handle comprises per se known rope holding elements having a recess with a V-shaped profile, to which in case of need any part of the rescue rope can be attached in a releasable way.

For the fast connection to the horseshoe life buoy it is preferred if at the end of the rescue rope which can be attached to the horseshoe life buoy a loop is provided, that has an opening being sufficiently large to allow threading of the handle with the winding of the rope there-through.

It is also preferred if the two rope holding rods are slightly inclined towards each other to facilitate easy and fast removal of the winding.

The invention will now be described in connection with preferable embodiments thereof, wherein reference will be made to the accompanying drawings. In the drawings.

Figure 2:
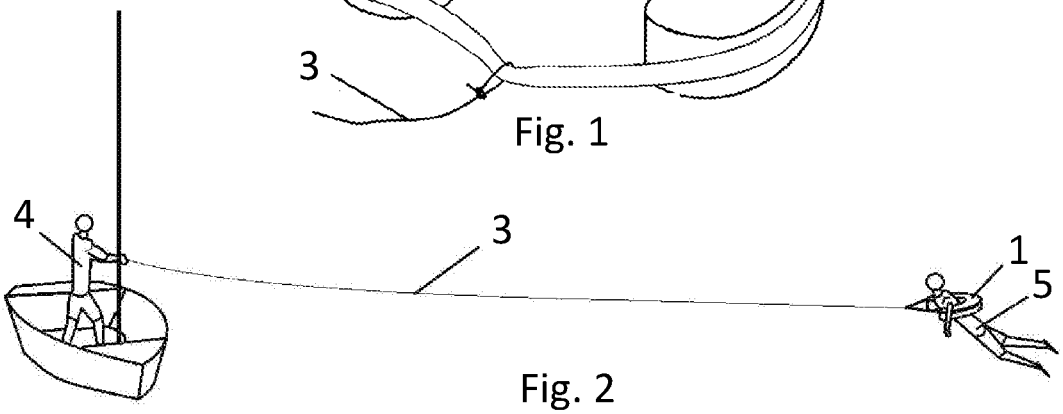
FIG. 2 shows a sketch of a rescue system at the correct use of a horseshoe life buoy as shown FIG. 1.
Figure 3:
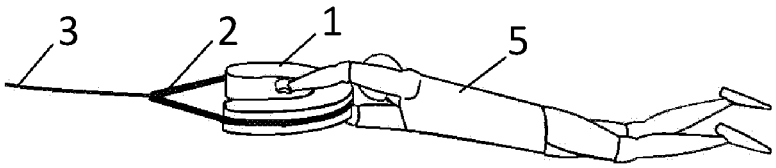
Figure 4:
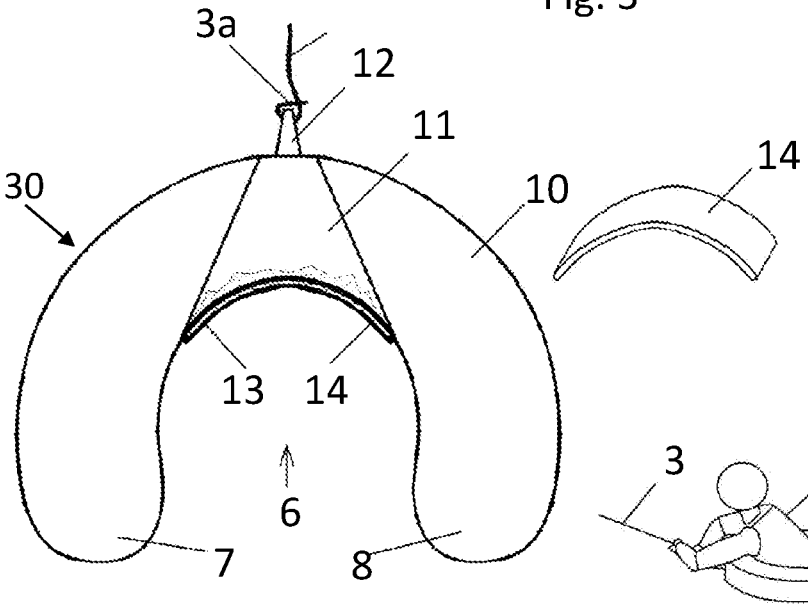
Figure 5:
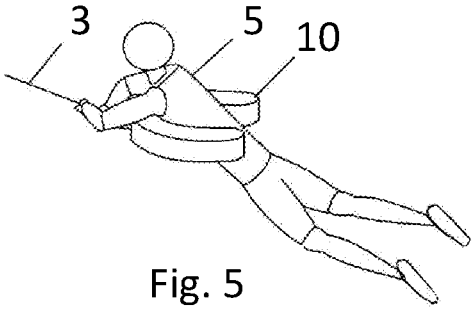
Figure 6:
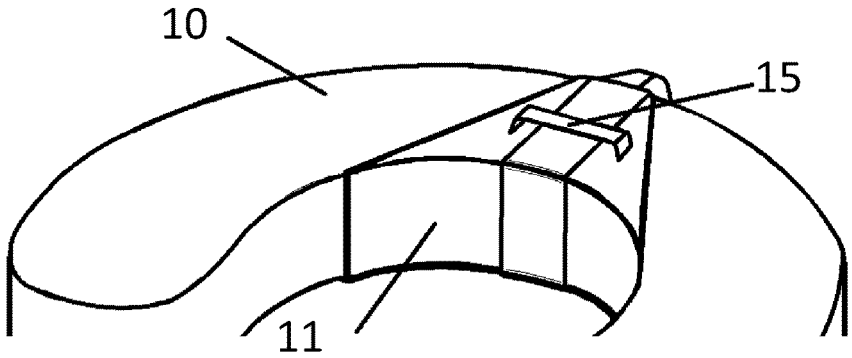
Figure 7:
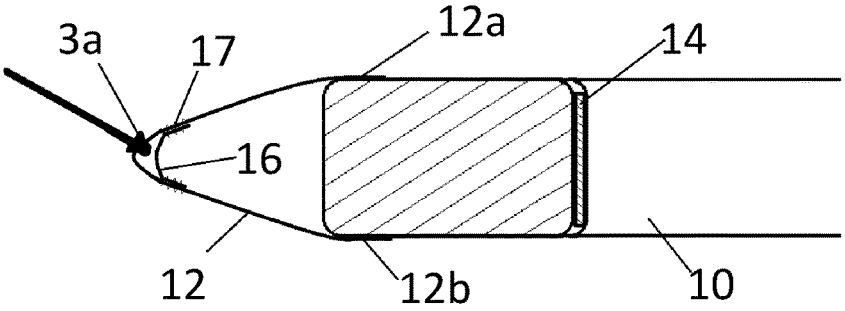
Figure 8:
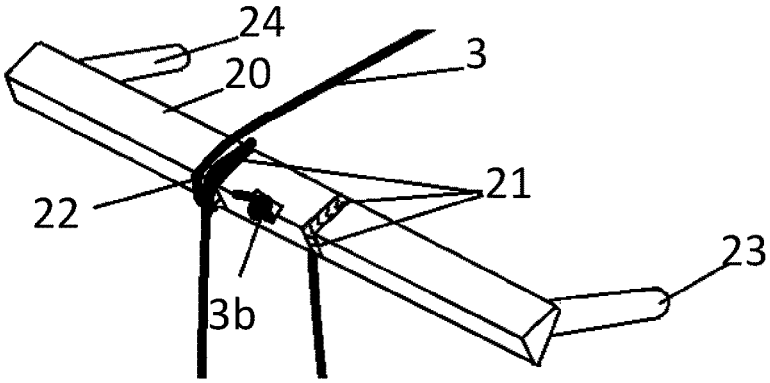
Figure 9:
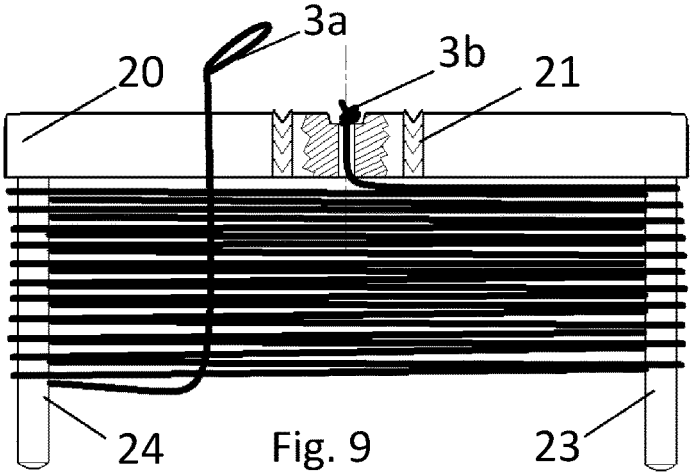
Figure 10:
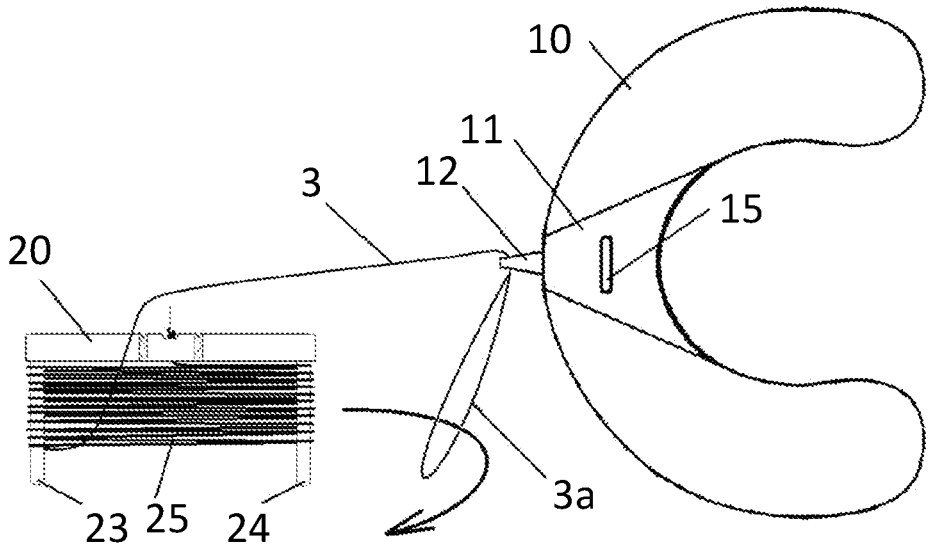
Figure 11:
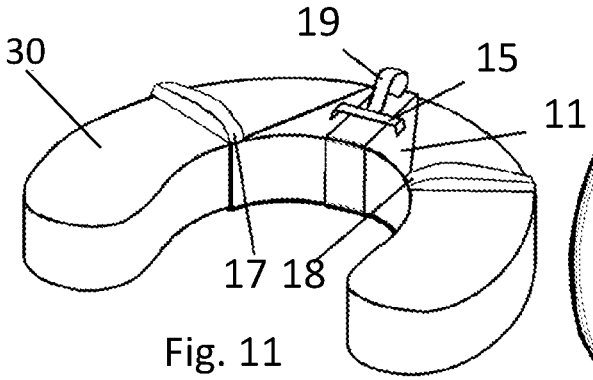
Figure 12:
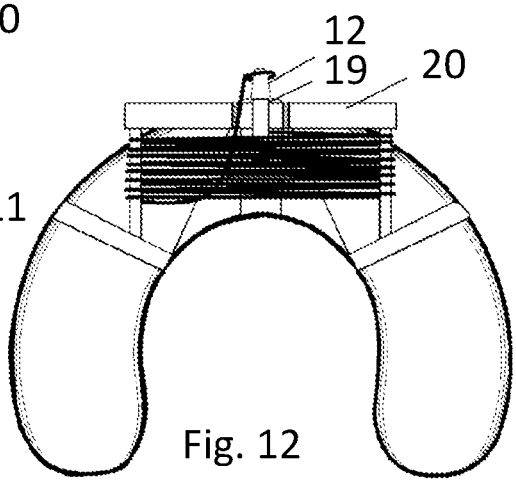
Figure 13:
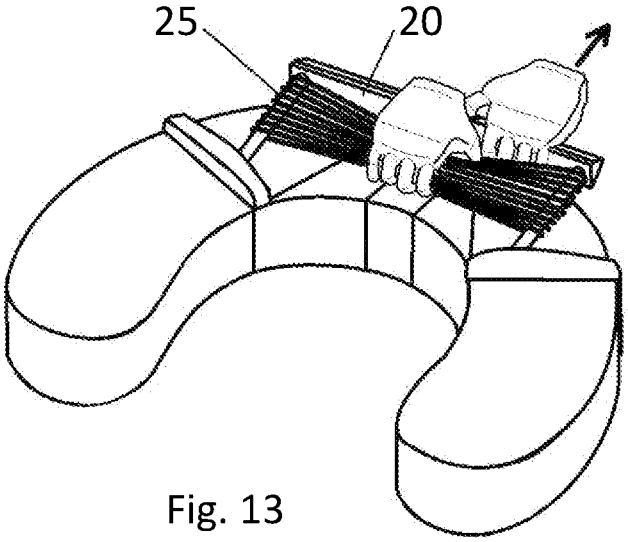

FIG. 3 a similar sketch to the FIG. 2, when there is a non-correct use of horseshoe life buoy;

FIG. 4 is a perspective view of an embodiment of horseshoe life buoy according to the invention;

FIG. 5 illustrates a correct use of horseshoe life buoy according to FIG. 4;

FIG. 6 shows an enlarged detail of the horseshoe life buoy 10;

FIG. 7 shows the sketch of the side view of the loop fastening strap 16;

FIG. 8 shows the sketch of the rescue rope assembly in case of unwound rope;

FIG. 9 is a sketch similar to that of FIG. 8 in case of a wound rope;

FIG. 10 is a sketch illustrating the looping of the end of the rescue rope 3;

FIG. 11 shows the design of the band 11 that receives the rescue rope assembly;

FIG. 12 shows the rescue rope assembly in a position fixed to the horseshoe life buoy;

FIG. 13 is a sketch showing the beginning of the throw; and

Figure 14:
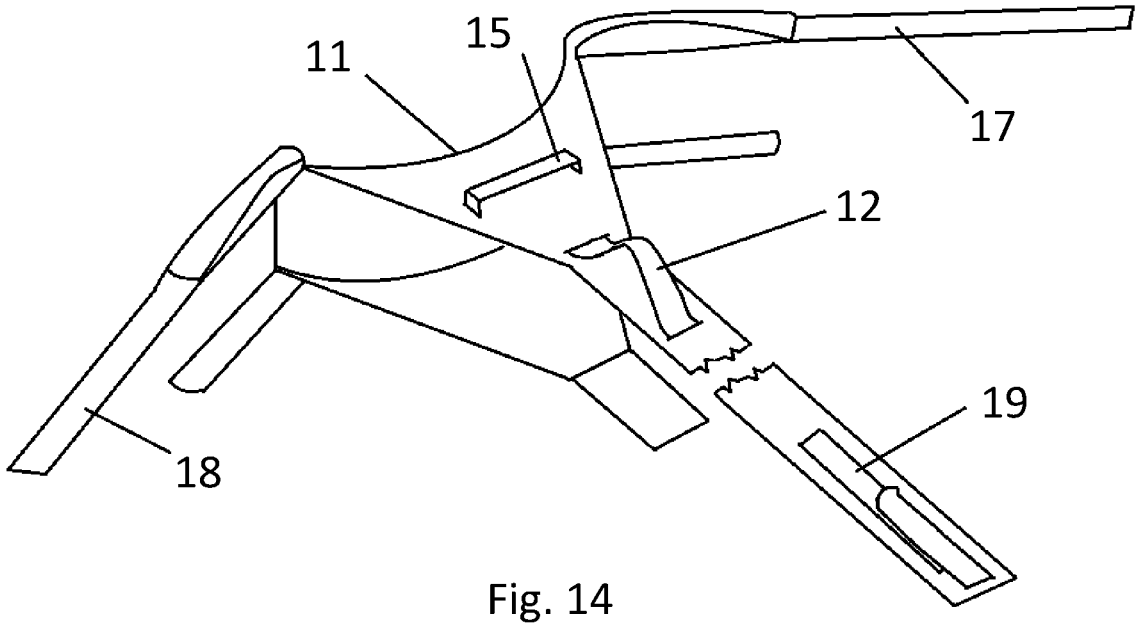

FIG. 14 shows the perspective view of the band 11 with partially unfolded fixing ribbons.

Figure 1:
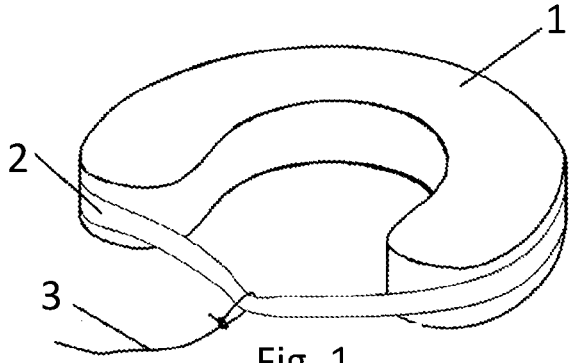
FIG. 1 shows the sketch of a known horseshoe life buoy.

Reference is made now to FIG. 4 that shows the perspective view of a horseshoe shaped life buoy 10 made according to the invention, which term will be used in the following simply as horseshoe life buoy. The design of the horseshoe life buoy 10 is substantially identical with that shown in FIG. 1, wherein between the two ends 7, 8 of the horseshoe an arced inner cavity 6 is formed. In this embodiment there is no need for using the belt 2 provided on the horseshoe life buoy 1 shown in FIG. 1 and also the loops are not required provided for the belt 2 (not shown in FIG. 1). At the same time the central section of body 30 of the horseshoe life buoy 10 is encircled by a specially designed force transmitting band 11 which comprises at the central part a strap 12 bridging the outer portion the thickness of the horseshoe life buoy 10, in which a loop 3*a* provided at the end of the rescue rope 3 can be threaded through, whereby the rescue rope 3 can be easily attached to the horseshoe life buoy 10. The band 11 has a spatial shape and it is made from a strong canvas or from an impregnated water resistant material, which widens towards the direction of the inner cavity 6 of the horseshoe life buoy 10 (that appears in the drawing as a triangle) and which is bent at the inner cavity 6 and fits to the curved inner surface 13 thereof. At the lower rear part (which is the covered rear face on FIG. 4) it has a rear portion which is substantially identical with the frontal triangular part and fits to the rear surface of the horseshoe life buoy 10, and at the upper portion the two sides are interconnected by respective Velcro straps in a releasable way. The band 12 can be positioned in a separate step on the body of the buoy 10 and follows and fits to its shape. Such a design is required because the pulling forces acting on the strap 12 are transmitted by the band 11 to the horseshoe life buoy 10, but this occurs along a large surface and primarily along the curved inner surface 13 of the horseshoe life buoy 10, whereby the pulling forces represent a pressing load distributed along a large surface, and the light foam material of the buoy can better resist such loads as if it was exposed to pulling loads or to loads acting along thin stripes. It is noted that the use of the band 11 shown in FIG. 4 represents a preferred option, because if the horseshoe life buoy 10 is made by a sufficiently strong material and if reinforcement inserts are provided in its body, then the band 11 can be omitted and the strap 12 can be attached to such reinforcement inserts. The advantage of the embodiment shown in FIG. 4 lies in that it can be used even together with existing horseshoe life buoys which are commercially available. For protecting the material of the horseshoe life buoy 10 and for the sake of even distribution of the acting forces a force distribution plate 14 can be positioned between the inner surface 13 and the arced inner surface of the band 11 which fits to the arced curved surfaces and can be made of a plastic or light metal material. For the sake of illustration this plate 14 is shown separately in FIG. 4 because in actual use it is in covered position between the band 11 and the horseshoe life buoy 10.

FIG. 5 is a simplified sketch similar to that of FIG. 3 and shows how the person to be rescued is positioned in the horseshoe life buoy 10. By the first glance it can be seen that in this case the placement for the person 5 to be rescued in the opening of the horseshoe is substantially easier than in case of the situation shown in FIG. 2 because his movement to get in is not barred by the presence of any rope, and during rescue the horseshoe life buoy is in front of the subject 5 and by grasping and hooking on to the horseshoe the subject 5 can easily withstand the pulling forces without the danger of his falling or turning out of the buoy.

Reference is made now to FIG. 6 which shows a detail of the horseshoe life buoy 10 with the band 11 on it. In the central region of the band 11 a transverse handle 15 is arranged normal to the central longitudinal axis, and it is fixed to the material of the band 11 which has sufficient width to receive the fingers of a hand. The presence of this transverse handle 15 has significance at the beginning of the rescue operation when the horseshoe life buoy has to be thrown out, because (as described among the problems of commercially available life buoys) existing buoys do not comprise a stable portion by which one could grasp the buoy itself and which would thus facilitate its throwing. The strap 12 appears to represent such a stable means, but in the reality it cannot be used for such a purpose as it is not stable and the end of the rescue rope 3 is fixed there to the horseshoe life buoy, and the presence of the rope at the throwing operation would certainly cause an obstacle. Therefore, slightly away from the strap 12 the presence of the transverse handle 15 offers a great help when the buoy has to be thrown far away.

Reference is made now to FIG. 7 which shows a side sectional view of a preferred embodiment of the strap 12. The strap 12 has end parts 12*a* and 12*b* which are attached by sewing or by strong Velcro straps to the upper parts of the two opposite planar surfaces of the band 11 and the strap 12 interconnect the width of the horseshoe life buoy in the central zone. This width is around 10-12 cm. To the inner central part of the strap 12 a second loop fixing strap 16 is attached, e.g. in such a way that both ends thereof are sewed or attached by a strong Velcro connection in a stable way to the strap 12. The task of the loop fixing strap 16 is to limit the displacement of the loop 3*a* along the length of the strap 12. The loop 3*a* is provided at the end of the rescue rope 3 which should be threaded into the strap 12. It can be seen in FIG. 7 that the loop 3*a* is positioned in the narrow space formed between the straps 12 and 16. Without using the loop fixing strap 16, then during the rescue operations the loop 3*a* could freely slide along the full length of the strap 12 i.e.

between the end parts 12*a* and 12*b* depending on the direction of the pulling force. In case the pulling force is not normal to the direction of the strap 12, then the loop 3*a* could slide along the strap 12 in the direction of the obliquely arriving force quite till the end of the strap 12, and could pull the horseshoe life buoy 10 by force when it gets stopped by the end of the strap. This might cause a sufficiently great insecurity, and the presence of the loop fixing strap 16 prevents this phenomenon to happen, whereby the horseshoe life buoy 10 can accurately follow the direction of the puling force and its uncertain oscillation (sensed by the rescued subject 5 as an excess fluctuation) will be reduced to minimum. It should be noted that such an oscillation effect is very apparent in case of conventional horseshoe life buoys, because if the rescue rope 3 can freely slide in lateral direction along the belt 2 that can cause a substantial instability and might also cause that the horseshoe life buoy get turned around its longitudinal axis. Thus, a similar fixing of the rescue rope 3 along the belt 2 might be associated with such a substantial advantage.

The problems connected with the placement of the rescue rope have already been mentioned earlier including those connected with its use, how it can be thrown away and how the rope can be stored, and it has also been mentioned that the solutions used so far for solving such problems are not at all at optimum, therefore the improvement of the efficiency requires not only the modification of the horseshoe life buoy itself but also the decrease of these listed problems.

FIG. 8 shows an embodiment for such a solution made according to the invention, and the basis of this solution is constituted by a rod-like handle 20 that can be held and grasped by hand in a comfortable way. In the handle 20 symmetrically to its centre respective pair of rope holding elements 21 are provided designed in the same way as used widely for holding a rope in sailing boats and other applications used in boats. This concerns respective deep recesses that narrow downward with a V profile, wherein the width of the recess fits to the size of the rescue rope 3. The rescue rope 3 can be fitted at any part thereof in the recess of one of the rope holding elements 21, and the rope 3 will get squeezed and caught in the recess and get connected to the handle 20 in a stable way, i.e. the holding and the pulling of the rescue rope 3 will not require that the rescuing subject 4 should hold the slippery rope 3 by his hand. If the handle 20 is turned opposite to the direction of the recess then the rope will get easily and immediately released from the rope holding element 21. FIG. 8 shows such a holding position 22. It is advisable to provide at least two of such rope holding elements 21 on the handle, whereby when the rope is caught by one element 21, then the rope 3 can be pulled towards our body by the handle 20 then the rope is caught in forward direction by the other rope holding element 21, then the previous connection can be released, and we can carry out a repeated pulling motion without the need of holding the rope directly by hand. From the two ends of the handle 20 respective rope winding rods 23, 24 extend out (like horns), and the presence of which facilitates the winding up of the rescue rope 3. A hole (being covered in FIG. 8) is provided in the middle of the handle 20 and the end of the rope 3 is lead through the hole and a knot 3*b* is made on that end which prevents its slipping out of the handle.

FIG. 9 shows the elevation view of the handle 20 on which the rescue rope 3 has been wound by a special winding that follows the shape of the number 8. This kind of winding is stable and can be learned easily in an almost automatic way, and it has the advantage that the full winding can be pulled off from the two rods 23, 24 by a single hand movement.

FIG. 10 shows the horseshoe life buoy 10 with the band 11 attached on it, and the handle 20 with the two rope holding rods 23, 24 on which the whole rescue rope 3 is wound in the form of winding 25. With this figure it was illustrated that the loop 3*a* made at the end of the rope 3 should be sufficiently long to make it possible that after the loop 3*a* has been led trough under the strap 12 (for the sake of better illustration the loop fixing strap 16 was not shown) then the whole winding 25 together with the handle 20 on which it is wound must be able to be led through the loop 3*a*, because this looping fixes the rescue rope 3 to the strap 12 and thereby to the band 11.

In FIG. 12 it can be observed that the handle 20 together with the rescue rope 3 wound on it can be easily attached to the horseshoe life buoy 10 in such a way, that from the two inner end parts of the band 11 respective ribbons 17, 18 (FIG. 11) extend out in substantially radial directions, and both of them is equipped at their end portions by respective strong Velcro locks. The ribbons 17, 18 each encircling the body 30 of the horseshoe life buoy 10 and on one of their surfaces respective pockets are made to receive and hold the ends of the rods 23, 24. The band 11 comprises additionally a further ribbon 19 extending from its central portion also provided with a Velcro lock, and as shown in FIG. 12 the ribbon 19 encircles and holds the handle 20. In such a way the horseshoe life buoy 10 together with the associated handle 20 and the assembly placed thereon (that can be thrown away) constitutes a stable unit with can be stored in a small space.

FIG. 13 shows the way how one can starting from the initial position shown in FIG. 12 throw the horseshoe life buoy 10 easily and quickly into the water when a sudden emergency situation arises so that the weight of the rope cannot brake down the throw i.e. one can throw buoy to a high distance. For such an operation one has to release the ribbon 19 that holds the handle 20 and grasp the handle 20 by one hand and use to other hand to grasp the winding 25 together with the transverse handle 15, then the handle 20 is pulled out from the pockets and from the winding 25 that constitutes the rope 3, then using a hand to throw the horseshoe life buoy 10 with the hand held winding 25 away in the required direction with a high force. During the throwing step by opening our hand the horseshoe life buoy 10 and the rope constituting the winding 25 are thrown and accelerated together, whereby the impulse of the horseshoe life buoy 10 cannot be braked down by the presence of the rope 3 because it will fly therewith, and the rope wound in the 8 shape will get wound down without any obstacle, and the throw takes place efficiently in a great distance.

It should be noted that for the sake of easier release of the winding 25 the two rods 23, 24 can be slightly inclined towards each other by a small angle.

FIG. 14 shows the band 11 in an unfolded state with the ribbons with their Velcro locks attached thereto. The short ribbons shown under the pocket holding ribbons 17 and 18 have the task to hold and fix the outer ends of the ribbons 17, 18 which embrace the branches of the horseshoe life buoy 10. Similarly, a short ribbon is shown that receives and holds the outer end of the ribbon 19 that embraces the upper end of the horseshoe life buoy 10. The drawing also shows the transverse handle 15.

The horseshoe life buoy 10 and the associated assembly solve together in an efficient way all problems described earlier in connection with rescuing subjects from water. At the same time one has to mention that among the advantages of the solution according to the invention several one will be present even if the horseshoe life buoy 10 is used with conventional ropes or if the handle according to the invention and the associated assembly are used for conventionally designed horseshoe life buoys.

The solution according to the invention simplifies the process of the rescuing operation i.e. it can be carried out easily by laymen, and the rescue will become possible even under stressed circumstances as the process gets faster. In short, the solution according to the invention facilitates and fastens the saving of subjects who have not lost their control and able to act.

The invention claimed is:

1. Horseshoe life buoy (10) for water rescue comprising a horseshoe shaped body lighter than water, having two ends, a center, a front, an outer edge, and between the two ends (7, 8) thereof a curved inner cavity (6) is provided which is sufficiently large to receive a subject (5) to be rescued, and for receiving of an end of a rescue rope (3) held by a subject (4) carrying out a rescue to the horseshoe life buoy (10) an attachment means is provided, characterized in that the attachment means is a strap (12) mechanically connected with the body of the horseshoe life buoy (10), which is arranged at the front of the horseshoe life buoy (10) at the center of the body at the outer edge opposite to the curved inner cavity (6), and wherein the strap (12) is connected to a band (11) that surrounds the center of the body of the horseshoe life buoy (10) which widens towards the curved inner cavity (6).

2. The horseshoe life buoy (10) as claimed in claim 1, characterized in that on one surface of the band (11) normal to the strap (12) a transverse handle (15) is arranged that facilitates throwing the horseshoe life buoy (10).

3. The horseshoe life buoy (10) as claimed in claim 2, characterized in that respective pocket holding ribbons (17, 18) are attached to two inner sides of the band (11) that encircle the body of the horseshoe life buoy (10) and on surfaces where the transverse handle (15) is arranged respective longitudinal pockets are formed, and on the band (11) a ribbon (19) is provided that holds the strap (12) and embraces the body of the horseshoe life buoy (10) and the ribbon (19) is provided with a Velcro lock.

4. The horseshoe life buoy (10) as claimed in claim 1, characterized in that to an interior of the strap (12) at a central section a loop fixing strap (16) is attached at both ends to the strap (12) and an end of a rescue rope (3) can be threaded in an opening formed between the strap and the loop fixing strap (12, 16).

5. The horseshoe life buoy (10) as claimed in claim 1, characterized in that between a widened inner surface (13) of the band (11) which is opposite to the strap (12) and an edge of the inner cavity (6) a curved force distribution plate (14) is arranged.

6. Life saving rope assembly for a horseshoe life buoy, that comprises a rescue rope (3) that can be connected by one end to the horseshoe life buoy (1, 10), characterized by comprising a rigid handle (20), a pair of rope holding rods (23, 24) extending out in the same direction from two ends of the handle (20), wherein an other end of the rescue rope (3) is fixed to the handle (20) and the rescue rope (3) can be wound between the pair of rope holding rods (23, 24).

7. The life saving rope assembly as claimed in claim 6, characterized in that the handle (20) comprises rope holding elements (22) having a recess with a V-shaped profile, to which in case of need any part of the rescue rope (3) can be releasably.

8. The life saving rope assembly as claimed in claim 7, characterized in that at the end of the rescue rope (3) which can be attached to the horseshoe life buoy (1, 10) a loop (3*a*) is provided, that has an opening being sufficiently large to allow threading of the handle (20) with the wound rope therethrough.

9. The life saving rope assembly as claimed in claim 6, characterized in that the pair of rope holding rods (23, 24) are slightly inclined towards each other to facilitate easy and fast removal of the wound rope (25).

10. The life saving rope assembly as claimed in claim 6, the horseshoe life buoy (10) for water rescue comprising a horseshoe shaped body lighter than water, having two ends, a center, a front, an outer edge, and between the two ends (7, 8) thereof a curved inner cavity (6) is provided which is sufficiently large to receive a subject (5) to be rescued, and for receiving of an end of a rescue rope (3) held by a subject (4) carrying out the rescue to the horseshoe life buoy (10) an attachment means is provided, characterized in that the attachment means is a strap (12) mechanically connected with the body of the horseshoe life buoy (10), which is arranged at the front of the horseshoe life buoy (10) symmetrically to the center of the body at the outer edge opposite to the curved inner cavity (6).

11. The life saving rope assembly as claimed in claim 10, characterized in that the strap (12) is connected to a band (11) that surrounds the center of the body of the horseshoe life buoy (10) which widens towards the inner cavity (6).

12. The life saving rope assembly as claimed in claim 11, characterized in that on one surface of the band (11) normal to the strap (12) a transverse handle (15) is arranged that facilitates throwing the horseshoe life buoy (10).

13. The life saving rope assembly as claimed in claim 12, characterized in that respective pocket holding ribbons (17, 18) are attached to two inner sides of the band (11) that encircle the body of the horseshoe life buoy (10) and on surfaces where the transverse handle (15) is arranged respective longitudinal pockets are formed, and on the band (11) a ribbon (19) is provided that holds the strap (12) and embraces the body of the horseshoe life buoy (10) and the ribbon (19) is provided with a Velcro lock.

14. The life saving rope assembly as claimed in claim 11, characterized in that to an interior of the strap (12) at a central section a loop fixing strap (16) is attached at both ends to the strap (12) and an end of a rescue rope (3) can be threaded in an opening formed between the strap and the loop fixing strap (12, 16).

15. The life saving rope assembly as claimed in claim 11, characterized in that between a widened inner surface (13) of the band (11) which is opposite to the strap (12) and an edge of the inner cavity (6) a curved force distribution plate (14) is arranged.

* * * * *